US010947817B2

(12) United States Patent
Kramm

(10) Patent No.: US 10,947,817 B2
(45) Date of Patent: Mar. 16, 2021

(54) METHODS AND SYSTEMS FOR A TOOL WITH ENCAPSULATED HEATING CABLE WITHIN A WELLBORE

(71) Applicant: Robert C Kramm, Red Rock, TX (US)

(72) Inventor: Robert C Kramm, Red Rock, TX (US)

( * ) Notice: Subject to any disclaimer, the term of this patent is extended or adjusted under 35 U.S.C. 154(b) by 0 days.

(21) Appl. No.: 16/522,811

(22) Filed: Jul. 26, 2019

(65) Prior Publication Data

US 2020/0056452 A1 Feb. 20, 2020

Related U.S. Application Data

(60) Provisional application No. 62/718,735, filed on Aug. 14, 2018.

(51) Int. Cl.

| | |
|---|---|
| ***E21B 36/00*** | (2006.01) |
| ***E21B 36/04*** | (2006.01) |
| ***E21B 17/00*** | (2006.01) |
| ***E21B 19/00*** | (2006.01) |

(52) U.S. Cl.

CPC ..... *E21B 36/005* (2013.01); *E21B 17/003* (2013.01); *E21B 19/00* (2013.01); *E21B 36/04* (2013.01)

(58) Field of Classification Search

CPC ..... E21B 36/00; E21B 36/04; E21B 36/005; E21B 36/006

See application file for complete search history.

(56) References Cited

U.S. PATENT DOCUMENTS

| | | | | |
|---|---|---|---|---|
| 3,114,417 | A * | 12/1963 | McCarthy | E21B 36/04 166/60 |
| 4,616,705 | A * | 10/1986 | Stegemeier | E21B 23/14 166/250.01 |
| 5,782,301 | A * | 7/1998 | Neuroth | H05B 3/56 166/302 |
| 6,009,940 | A * | 1/2000 | Eck | E21B 36/04 166/302 |
| 6,148,925 | A * | 11/2000 | Moore | E21B 17/206 16/81 |
| 6,192,983 | B1 | 2/2001 | Neuroth et al. | |
| 6,497,279 | B1 | 12/2002 | Williams et al. | |
| 6,540,018 | B1 | 4/2003 | Vinegar et al. | |
| 7,475,724 | B2 | 1/2009 | Pribnow et al. | |
| 7,730,936 | B2 | 6/2010 | Hernandez-Solis et al. | |
| 8,939,207 | B2 | 1/2015 | De St. Remey et al. | |
| 9,416,640 | B2 | 8/2016 | Parman et al. | |
| 2002/0023751 | A1* | 2/2002 | Neuroth | E21B 23/14 166/302 |
| 2003/0037927 | A1* | 2/2003 | Dalrymple | E21B 36/04 166/302 |
| 2007/0125163 | A1* | 6/2007 | Dria | E21B 17/206 73/152.18 |
| 2015/0233211 | A1 | 8/2015 | Bujold et al. | |

* cited by examiner

*Primary Examiner* — David Carroll
(74) *Attorney, Agent, or Firm* — Pierson IP, PLLC

(57) ABSTRACT

Examples of the present disclosure relate to systems and methods for an encapsulated heating cable within a wellbore. Embodiments may have the durability required for the hazardous and harsh environment of a wellbore, and to provide sufficient heat within the production string to reduce and/or eliminate deposits.

20 Claims, 4 Drawing Sheets

METHODS AND SYSTEMS FOR A TOOL WITH ENCAPSULATED HEATING CABLE WITHIN A WELLBORE

BACKGROUND INFORMATION

Field of the Disclosure

Examples of the present disclosure relate to systems and methods for a heating cable positioned within a wellbore. Specifically, embodiments are directed towards a heating cable positioned within a production string that is configured to be coiled such that the heating cable is manipulated within the production string and is positioned adjacent to the production string.

Background

Hydraulic injection is a method performed by pumping fluid into a formation at a pressure sufficient to create fractures in the formation. When a fracture is open, a propping agent may be added to the fluid. The propping agent, e.g. sand or ceramic beads, remains in the fractures to keep the fractures open when the pumping rate and pressure decreases or ceases. During a production stage, oil and gas may flow from the fractures towards the upper sections of the wellbore. However, deposits forming in the upper sections of the wellbore can significantly limit and reduce the oil and gas productions.

Conventionally, to eliminate or reduce the size and numbers of deposits formed in the upper sections of a wellbore, operators have pumped hot fluid or chemicals directly into the wellbore. However, pumping hot fluid or chemicals causes downtime and introduces additional elements, costs, and complexity to the operations. In other conventional systems, a linear heated cable is inserted into the wellbore. However, linear cables allow the heat within the wellbore to be dissipated quickly, and also do not have a high surface area impact zone.

Accordingly, needs exist for system and methods for a heated cable that may be coiled and positioned adjacent to the inner circumference of the production string which may allow for a more uniform and efficient heat distribution within the production string with a minimum impact on flow area in the wellbore.

SUMMARY

Examples of the present disclosure relate to systems and methods for an encapsulated heating cable within a wellbore. Embodiments may have the durability required for the hazardous and harsh environment of a wellbore, and to provide sufficient heat within the production string to reduce and/or eliminate deposits. Embodiments may include a production string, heating cable, twist inducer tip, and a control module.

The production string may be a hollow tubing that is a conduit through which production fluid flows from the subsurface reservoir to the surface through a wellhead. The production string may be configured to contain fluids from contaminating the environment or eroding other well structures, such as casing. A first end of the production string may be coupled with a completion tree, and a second end of the production string may be positioned down well.

The heating cable may be a cylindrical, oblong, or oval shaped cable comprised of materials that can withstand the harsh operating conditions of a production string, while transferring heat from the heating cable to the production string and materials within the production string. The heating cable may have a first end that is coupled to the wellhead, and a second end that is positioned within the production string. More specifically, the second end of the heating cable may be positioned adjacent to a tubing stop or other form of anchor. The heating cable may be configured to contact an inner circumference of the production string, which may allow convective and conductive heat transfer within the production string. The heating cable may be oblong or oval shaped to increase a surface area of the heating cable directly contacting the inner surface of the production string. In embodiments, the heating cable may be configured to emit and transfer uniform heat throughout aligned areas of the production string. In other embodiments, the heating cable may be configured to emit and transfer non-uniform heat at different areas of the production string. For example, in embodiments, the heating cable may produce more heat at an area closer to a proximal end of the production string than an area closer to a distal end of the production string.

The twist inducer tip may be positioned within a completion string, and may be configured to control the angularity and height of the coil of the heating cable. The twist inducer tip may be configured to modify the parameters of the coil of the heating cable based on the inner diameter of the production string, depth needed to deploy the heating cable, angle of the wellbore, and the external diameter of the heating cable.

The control module may be a device that is configured to supply power and control the temperature of the heating cable. The control module may be configured to regulate the temperature of the heating cable based on the operating envelope of the well, and temperature required to optimize the conditions of the well and fluid properties.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
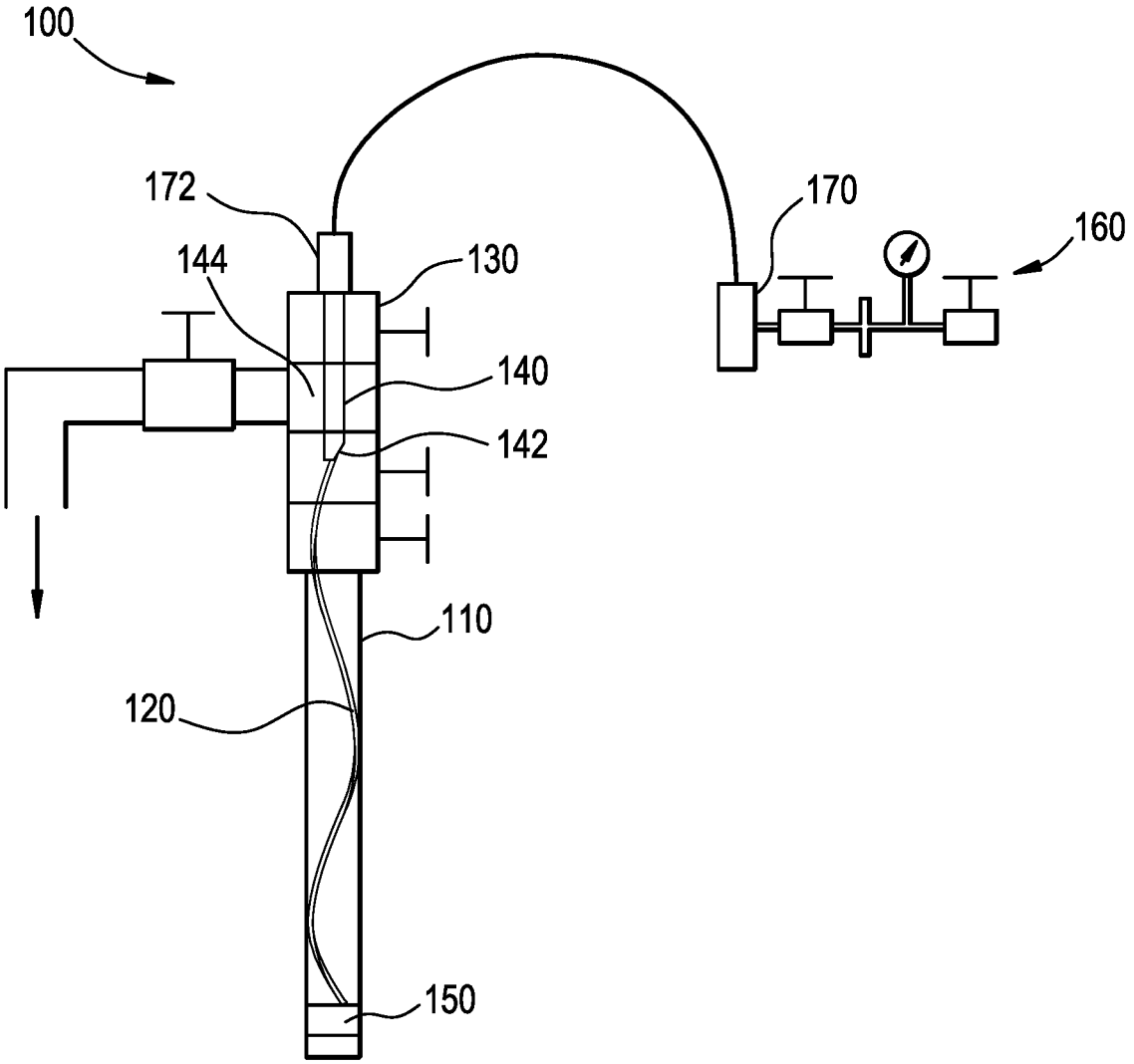
FIG. 1 depicts a system configured to heat a wellbore, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts a system 100 configured to heat a wellbore, according to an embodiment. In embodiments, system 100 may be configured to apply heat within a wellbore to reduce the size and numbers of deposits formed in the upper sections of the wellbore. System 100 may include a production string 110, heating cable, 120, completion tree 130, protector or twist inducer 140, tubing stop or anchor 150, and power/controls 160.

Production string 110 may be a hollow tubing that is a conduit through which production fluid flows from a hydrocarbon reservoir to the surface. Production string 110 may be configured to contain fluids from contaminating the environment or eroding other well structures, such as casing. Production string 110 may have a first end that is positioned adjacent to completion tree 130, and a second end of production string 110 may be positioned down well.

Heating cable 120 may be a cable comprised of materials that can withstand the harsh operating conditions of production string 110, while transferring heat from heating cable 120 to the production string 110 and to areas within production string 110. Heating cable 120 may also be formed of materials that are configured to coil in a spiral or sequence of rings. In embodiments, heating cable 120 may be cylindrical, oblong, or oval in shape. Heating cable 120 may have a first end that is configured to be coupled or embedded within twist inducer tip 142, a body that may be configured to be positioned adjacent to the inner circumference of production string 110, and a second end positioned down well contacting tubing stop or anchor 150. In embodiments, at least a portion of the outer circumference of heating cable 120 may be positioned directly adjacent to and contacting the inner diameter of production string 110. When heating cable 120 contacts the inner diameter of production string 110, heating cable 120 may transfer heat through convective and conductive heat transfer within the production string 110. This may increase that total volume and/or area of heat transfer from heating cable 120 to areas within production string 110. To increase the surface area of heating cable 120 contacting production string 110, heating cable may be oblong or oval in shape, wherein a longer section of the heating cable 120 may contact the inner diameter of the production string 110. Furthermore, because heating cable 120 may be coiled within production string 110 areas more proximate to the inner diameter of production string 110 may receive more heat than areas aligned within a central axis of production string 110. In implementations, heating cable 120 may have a uniform coil, or heating cable 120 may have a non-uniform coil where a coil height closer or further from a proximal end of production string 110 may have a larger or smaller coil height. This may enable heating cable 120 to create areas within production string 110 that have higher temperatures or lower than other areas. In embodiments, the twist inducer tip 142 may be located in an extension section above the completion tree 130. In embodiments, encapsulating heating cable 120 may allow for the use of a heat transfer fluid within the heating cable 120. The fluid may be configured to increase a mass of the heating cable. The extra weight may reduce a duty cycle associated with heating cable, and thus extending the life of heating cable 120.

Tubing stop 150 may be positioned downhole from completion tree 130, and may be configured to restrict the downward movement of heating cable 120. Tubing stop 150 may be a lip, restriction, etc. positioned on the inner diameter of production string 110, and may be configured to receive a second end of heating cable 120. Responsive to positioning the second end of heating cable 120 on tubing stop 150, heating cable 120 may not be able to travel further down hole and may be coiled within production string 110. This may enable the heating cable 120 to be coiled under pressure. In further embodiments, tubing stop 150 may be an anchor at a distal end of the cap string that may be deployed once the heating cable 120 is at depth, then the weight of the heating cable 120 is slacked, and the heating cable 120 is coiled. This may create more effective and efficient contact between heating cable 120 and production string 110.

Completion tree 130 may be positioned at the surface of the wellbore, and may be configured to provide control of the subsurface conditions of the well. Completion tree 130 may include tubing that is configured to house protective joint 140 and twist inducer tip 142. In implementations, completion tree 130 may have a different inner diameter than that of production string 110.

Protective joint 140 may be tubing that is externally hardened to protect against erosion at a production cross section or tee section 144. For example, protective joint 140 may be comprised of hardened steel. Protective joint 140 may have a first end that is coupled to an upper surface of the completion tree, and extend past a production cross section 144. A second end of protective joint 144 may be coupled to twist inducer tip 142. In implementations, protective joint 140 may be aligned with a central axis of production string 110. In other implementations, the completion tree 130 may be extended upward to allow housing the protective joint 140 and twist inducer 142 outside the flow path of wellbore fluids.

Twist inducer tip 142 may be positioned on a distal end of protective joint 140, and may be coupled to a proximal end of heating cable 120. Twist inducer tip 142 may be positioned tangential to or intersect a central axis of production string 110, and may be configured to induce a helix upon heating cable 120 within completion tree 130 below cross section 144. This may ensure exterior contact of heating cable 120 and production string 110. However, in other embodiments, twist inducer tip 142 may be positioned within the production string 110. In embodiments, the angle of twist inducer tip 142 may be configured to control properties of the coil of heating cable 120, such as coil angle, coil distance, etc. The angle of twist inducer tip 142 may be controlled based on the internal diameter of production string 110, depth required to deploy heating cable 120, angle of the wellbore and external diameter of heating cable 120.

Control module 160 may be a device that is configured to supply power and control the temperature of heating cable 120. Control module 160 may be configured to regulate the temperature of the heating cable 120 based on the operating envelope of the well, and temperature required to optimize the conditions of the well and fluid properties. In embodiments, control module 160 may be powered by solar panels, electric generators, motors, etc.

In embodiments, protective joint 140 may be coupled to dual packoff seals 172, 170 positioned on completion tree 130 and control module 160, respectively. Dual packoff seals 172, 170 may be configured to provide ports to fill, bleed, and monitor pressure of fluid between heating cable 120 and heating cable encapsulation.

Figure 2:
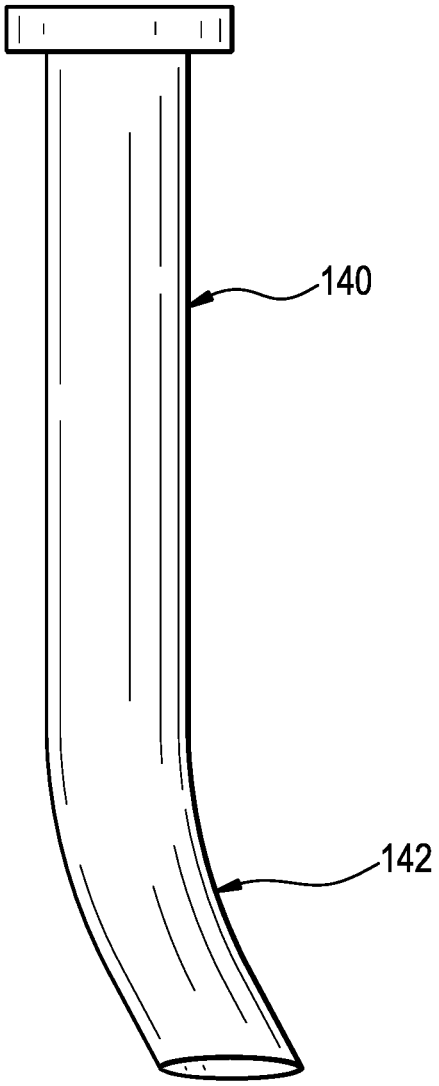
FIG. 2 depicts a protective joint and twist inducer tip, according to an embodiment.

FIG. 2 depicts protective joint 140 and twist inducer tip 142, according to an embodiment. Elements depicted in FIG. 2 may be described above, and for the sake of brevity a further description of these elements is omitted.

Figure 3:
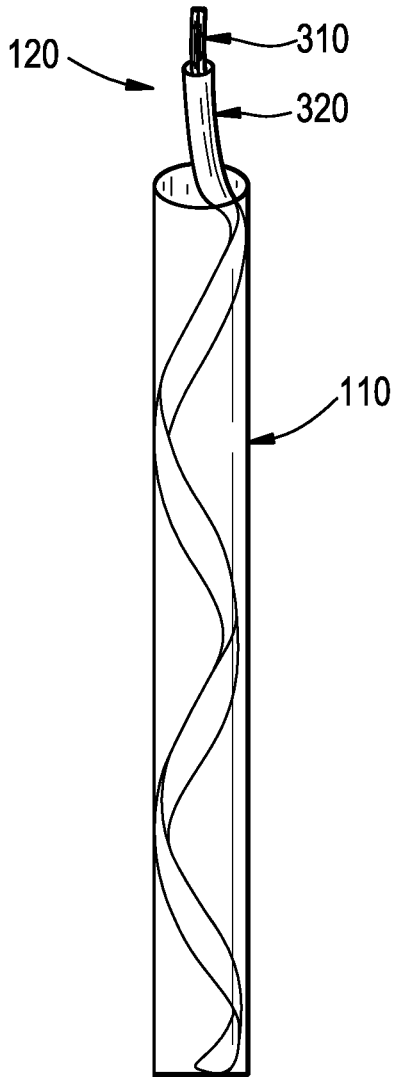
FIG. 3 depicts a heating cable, according to an embodiment.

As depicted in FIG. 2, protective joint 140 may extend in a direction in parallel or overlaid on a central axis of production string 110. Twist inducing tip 142 may be positioned at a distal end of protective joint at an angle that intersections protective joint 140, which may enable heated cable 120 to be coiled. In embodiments, a length of protective joint 140 may be substantially longer than that of twist inducing tip 142. Twist inducing tip 142 may be adjustable in certain embodiments to allow changes in helix based on well conditions. By varying the parameters associated with twist inducing tip 142, the geometrical properties associated manipulation of heating cable 120 may correspondingly change. For example, the distance between verticies of the heating cable 120 within production string 110 may change, and angle of rotation of a coil associated with heating cable 120 may change, etc. FIG. 3 depicts heating cable 120, according to an embodiment. Elements depicted in FIG. 3 may be described above, and for the sake of brevity a further description of these elements is omitted.

As depicted in FIG. 3, heating cable 120 may be configured to be embedded and coiled within production string 110, such that heating cable 120 continuously contacts the inner circumference of production string 110.

Furthermore, heating cable 120 may include cable 310 and capillary string 320, wherein cable 310 is configured to supply the heat to heating cable 120 and be embedded within capillary string 320. Capillary string 320 may be a small tube, string, etc. that is configured to house cable 310. In embodiments, capillary string 320 may be formed of flexible material such that bend, coil, etc. can be positioned within production string 110. Additionally, the coil caused by capillary string 320 may apply pressure against the inner circumference of production string 110 to hold heating cable 120 in place. This pressure may extend towards production string 110 in a direction that is substantially perpendicular to a central axis of projection string 110.

In embodiments, capillary string 320 may be filled with a dielectric fluid, heating oil, materials that are configured to change phase, etc. The dielectric fluid may be configured to prevent or reduce electric discharges with capillary string, while also evenly transferring heat from the cable 310 to heating cable 120.

Figure 4:
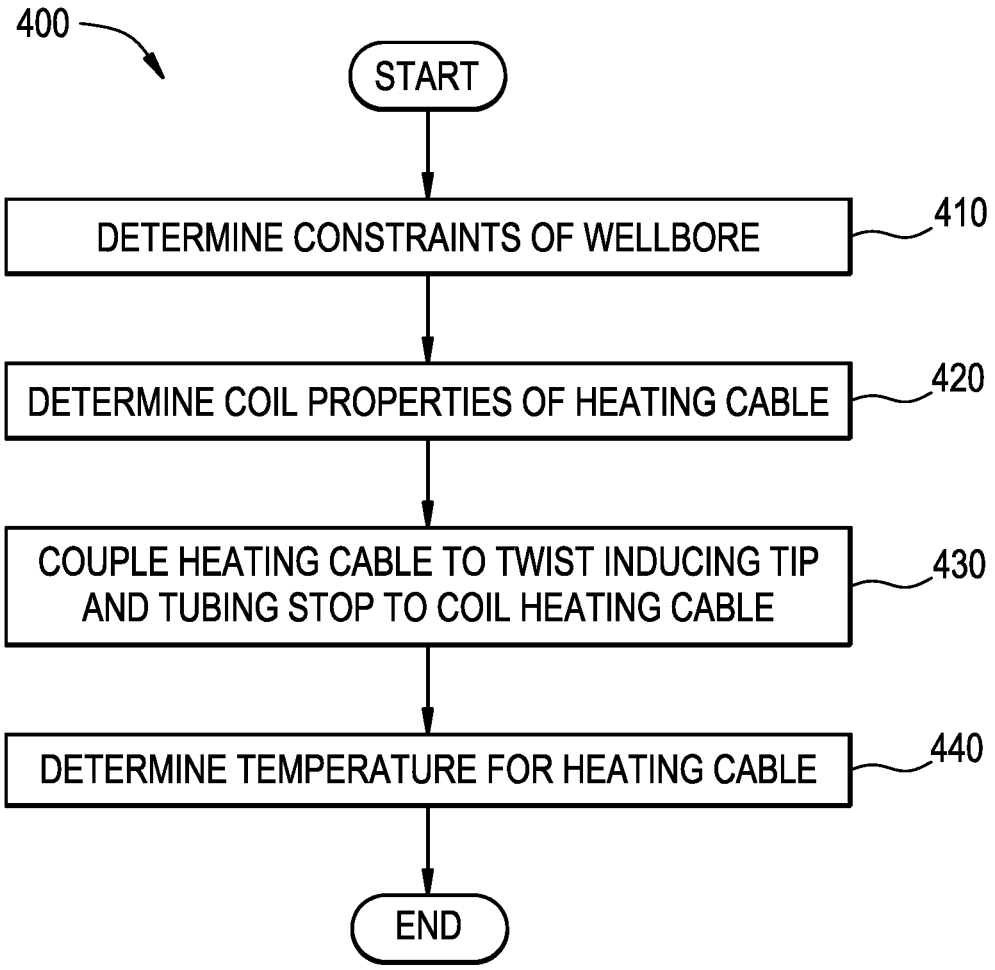
FIG. 4 depicts a method for a heating cable within a wellbore, according to an embodiment.

FIG. 4 depicts a method 400 for a heating cable within a wellbore, according to an embodiment. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting. Furthermore, the operations of method 400 may be repeated in a well.

At operation 410, determine constraints of wellbore based on internal diameter of production string, depth needed to deploy the heating cable, angle of wellbore, and external diameter of the heating cable.

At operation 420, the angle and height of the coils of a heating cable may be determined based on the constraints of the wellbore.

At operation 430, the heating cable may be coupled to a protective joint and twist inducing tip at a first end and a tubing stop at a second end to coil the heating cable within the wellbore. The heating cable may be coiled such that the heating cable continuously is in contact with an inner circumference of the production string from a proximal most end of the production string towards a distal end of the production string. This may allow more uniform distribution of heat from the heating cable to the areas within the production string via conduction and convention.

At operations 440, a temperature to heat the heating cable within a production string may be determined based on the operating envelope of the well, conditions of the well, fluid properties within the wellbore, and deposits within the production string. In embodiments, the temperature of the heating cable may be dynamically changed to provide sufficient heat to reduce, eliminate, deposits within the upper sections of the production string during production.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the protective joint may be above the second valve on the production tree.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for heating a wellbore, the system comprising:

a production string with a first inner diameter;

a heating cable positioned within the production string, wherein the heating cable is manipulated to contact the first inner diameter of the production string, the heating cable being coiled under pressure, wherein the heating cable is configured to provide sufficient heat within the production string to reduce deposits within the production string during production;

a tubing stop being a lip positioned on the first inner diameter of the production string, the tubing stop being configured to receive a distal end of the heating cable to restrict a downward movement of the heating cable, wherein the heating cable is configured to be coiled under pressure responsive to positioning the distal end of the heating cable on the tubing stop;

a capillary string configured to encompass the heating cable, wherein the capillary string is filled with dielectric fluid.

2. The system of claim 1, wherein the heating cable is oblong in shape.

3. The system of claim 1, further comprising:

an anchor position on a distal end of the heating cable to restrict a downward movement of the heating cable, wherein the anchor is deployed once the heating cable is at depth.

4. The system of claim 1, further comprising:

a completion tree with a second inner diameter, the second inner diameter being greater than the first inner diameter, wherein a proximal end of the heating cable is positioned within the completion tree.

5. The system of claim 4, further comprising:

a protective joint with a twist inducing tip configured to be coupled to the proximal end of the heating cable.

6. The system of claim 5, wherein the twist inducing tip is configured to coil the heating cable.

7. The system of claim 6, wherein the heating cable is coiled within the completion tree.

8. The system of claim 7, wherein a length and angle of the coil of the heating cable is based on the operating envelope of the well.

9. The system of claim 8, wherein the length and angle of the coil of the heating cable can dynamically change while positioning in the production string by adjusting the twist inducing tip.

10. The system of claim 1, wherein the heating cable continuously contacts the inner diameter of the production string to provide uniform distribution of heat from the heating cable to areas within the production string through conduction and convections.

11. A method for heating a wellbore, the method comprising:

positioning a production string with a first inner diameter within a wellbore;

manipulating a heating cable within the production string to contact the first inner diameter of the production string;

positioning a distal end of the heating coil on a tubing stop, the tubing stop being a lip being positioned on the first inner diameter of the production string, the tubing stop restrict a downward movement of the heating cable;

coiling the heating cable under pressure;

creating, via the heating cable, sufficient heat within the production string to reduce deposits within the production string during production;

encompassing the heating cable in a capillary string, wherein the capillary string is filled with dielectric fluid.

12. The method of claim 11, wherein the heating cable is oblong in shape.

13. The method of claim 11, further comprising:

positioning an anchor on the distal end of the heating cable to engage with the production string when heating cable reaches a required depth, wherein the anchor is deployed once the heating cable is at depth.

14. The method of claim 13, further comprising:

positioning a proximal end of the heating cable within a completion tree, the completion tree having a second inner diameter, the second inner diameter being greater than the first inner diameter.

15. The method of claim 14, further comprising:

positioning a protective joint within the completion tree, the protective joint including a twist inducing tip configured to be coupled to the proximal end of the heating cable.

16. The method of claim 15, further comprising:

coiling the heating cable via the twist inducing tip.

17. The method of claim 16, wherein the heating cable is coiled within the completion tree.

18. The method of claim 17, wherein a length and angle of the coil of the heating cable is based on the operating envelope of the well.

19. The method of claim 18, further comprising:

changing the length and angle of the coil of the heating cable while positioning in the production string by adjusting the twist inducing tip.

20. The method of claim 11, wherein the heating cable continuously contacts the inner diameter of the production string to provide uniform distribution of heat from the heating cable to areas within the production string through conduction and convections.

* * * * *